US007604582B2

(12) United States Patent
Abdallah

(10) Patent No.: US 7,604,582 B2
(45) Date of Patent: Oct. 20, 2009

(54) PUSH-UP STAND WITH KNUCKLE SUPPORT SURFACE

(76) Inventor: Michael Abdallah, 622 n. Connecticut Ave., Royal Oak, MI (US) 48067

( * ) Notice: Subject to any disclaimer, the term of this patent is extended or adjusted under 35 U.S.C. 154(b) by 0 days.

(21) Appl. No.: 11/953,408

(22) Filed: Dec. 10, 2007

(65) Prior Publication Data

US 2009/0149305 A1 Jun. 11, 2009

(51) Int. Cl.
*A63B 26/00* (2006.01)

(52) U.S. Cl. ..... 482/141; 482/62

(58) Field of Classification Search ..... 482/141, 482/62, 75–80, 37, 44
See application file for complete search history.

(56) References Cited

U.S. PATENT DOCUMENTS 4,629,181 A * 12/1986 Krive ..... 482/71
5,413,543 A * 5/1995 Drago ..... 482/49
5,593,373 A * 1/1997 Hale ..... 482/75
5,980,351 A * 11/1999 McCook ..... 446/26
6,716,108 B1 * 4/2004 Middleton et al. ..... 472/135
7,063,646 B1 * 6/2006 Slimi ..... 482/45
7,326,153 B2 * 2/2008 Bond ..... 482/92
2007/0298947 A1 * 12/2007 Eksteen ..... 482/141

* cited by examiner

*Primary Examiner*—Lori Amerson
(74) *Attorney, Agent, or Firm*—Gifford, Krass, Sprinkle, Anderson & Citkowski, P.C.

(57) ABSTRACT

A push-up stand is provided with a base; a support portion extending upwardly from the base; and a platform supported above the base by the support portion. The platform has an upper support surface for supporting the knuckles of a person doing push-ups. The platform has an upstanding wall extending along a perimeter of the upper support surface. The upper support surface is generally planar. The upper support surface may be textured to promote formation of calluses on the person's knuckles.

18 Claims, 2 Drawing Sheets

PUSH-UP STAND WITH KNUCKLE SUPPORT SURFACE

FIELD OF THE INVENTION

The invention relates to push-up stands. More particularly, the invention relates to a push-up stand having a support surface for contacting and supporting the knuckles of a person performing push-ups while the person's hands are in a fist or closed grip position.

BACKGROUND OF THE INVENTION

People perform push-ups to strengthen their chest and arm muscles. Push-up stands are widely known to enhance the effectiveness of performing push-ups. Typically, push-up stands include a cylindrical bar supported horizontally above the floor by a base. Push-up stands are used in pairs. A person grips a bar of a push-up stand in each hand and performs push-ups. The extra height provided by the bar spaced above the base allows the person's chest to move below their hands, thereby providing a greater range of motion during each push-up.

Some people prefer to perform "knuckle push-ups" with their hands in the form of a fist to further strengthen wrists and also to condition muscles used in punching. Performing knuckle push-ups also toughens the flesh along a person's knuckles, which is advantageous to those engaged in combat or martial arts.

It remains desirable to provide a push-up stand design that supports a persons hands above the ground to allow a greater range of motion during each push-up and, at the same time, allows a person to perform knuckle push-ups.

SUMMARY OF THE INVENTION

According to one aspect of the invention, a push-up stand is provided with a base; a support portion extending upwardly from the base; and a platform supported above the base by the support portion. The platform has an upper support surface for supporting the knuckles of a person doing push-ups. The platform has an upstanding wall extending along a perimeter of the upper support surface.

According to another aspect of the invention, a push-up stand includes a base having opposite top and bottom surfaces; a support portion extending upwardly from the top surface of the base; and a platform supported above the base by the support portion. The platform has a generally planar upper support surface for supporting the knuckles of a person doing knuckle push-ups.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

Figure 1:
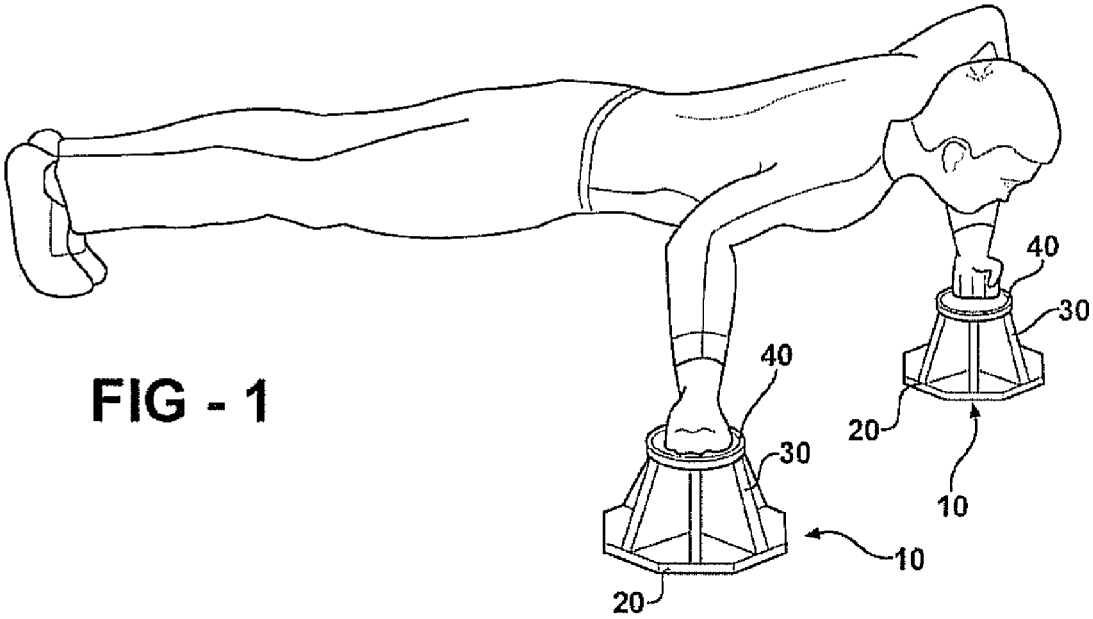
FIG. 1 is a perspective view of a pair of push-up stands according to one embodiment of the invention, while being used by a person performing knuckle push-ups.

Referring to FIG. 1, a pair of push-up stands 10 according to one embodiment of the invention is shown being used by a person performing elevated knuckle push-ups. Each push-up stand 10 includes a base 20 and a support portion 30 extending upwardly from the base 20. The base 20 includes a substantially planar bottom surface 22. Each push-up stand 10 also includes a platform 40 supported above the base 20 by the support portion 30.

Figure 2:
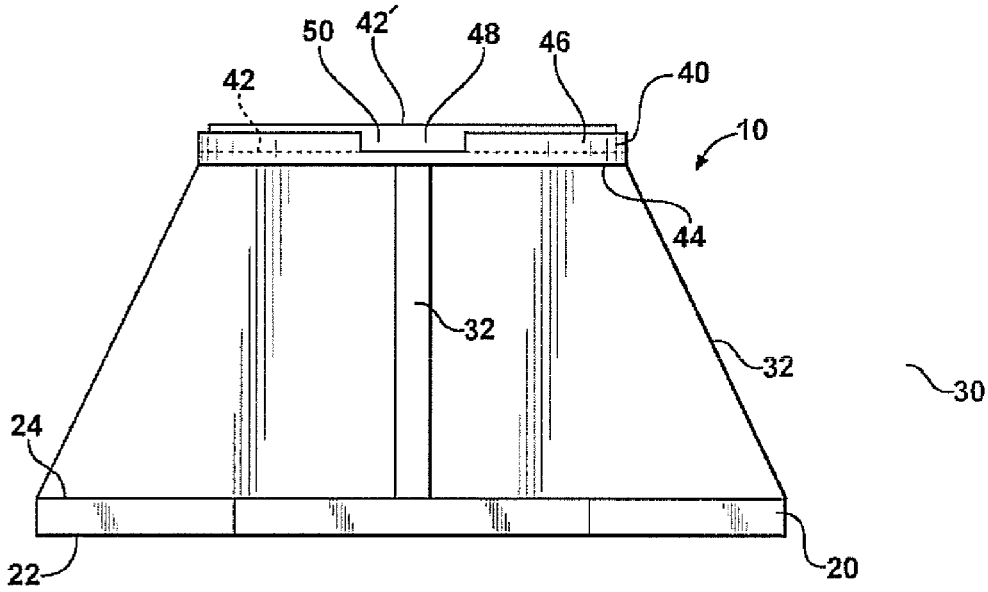
FIG. 2 is a side elevational view of one of the push-up stands.
Figure 3:
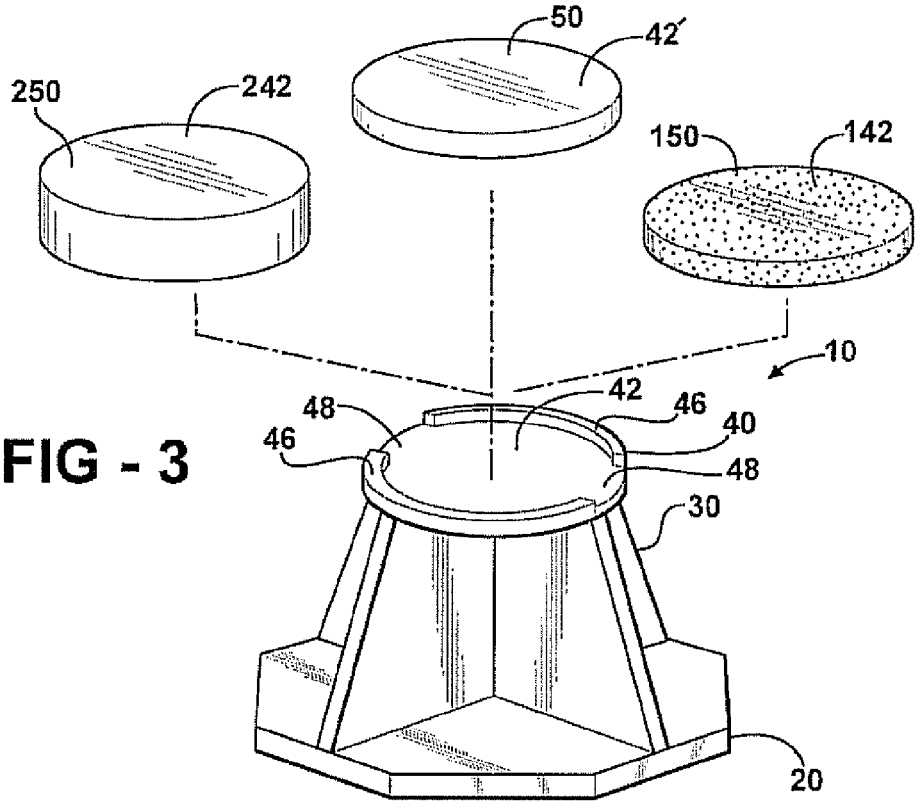
FIG. 3 is a perspective view of one of the push-up stands and a plurality of inserts which can be placed along an upper support surface of the push-up stand.
Figure 4:
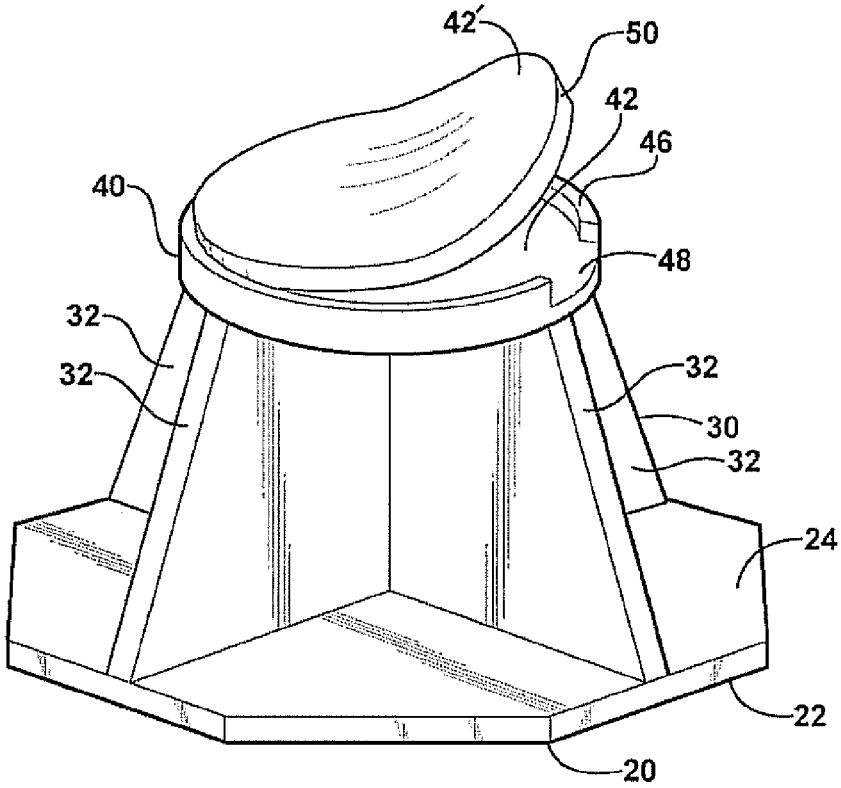
FIG. 4 is a perspective view of one of the push-up stands and one of the inserts being placed or removed from an upper support surface of the stand.

Referring to FIGS. 2-4, the platform 40 has an upper support surface 42 for supporting the knuckles of the person doing push-ups. The support surface 42 is generally planar. The support surface 42 may be grained or textured to promote formation of calluses on the person's knuckles during use.

The support surface 42 may also support custom inserts 50, 150, 250 to provide support surfaces 42', 142, 242 of varying textures and/or hardness to accomodate the needs of various users. One insert, for example, may be formed of a soft rubber, another insert may be formed of a harder rubber, while another insert may be rigid and/or provide a texture different from the underlying support surface 42 of the stand 10. Rough and hard surface would be useful for experienced karate practitioners that are engaged in bare knuckle combat sports, while non-abrasive surfaces would be useful for those who are involved in combat sports that require the use of gloves and, therefore, have no need to toughen the skin. In either case, the stands 10 helps the user to strengthen the knuckles, hands, wrists, and forearms by facilitating a greater range of motion and enhanced efficiency while performing knuckle push-ups.

The platform 40 may have an upstanding wall 46 that extends along a perimeter of the support surface 42. The wall 46 forms a recess for receiving and retaining an insert 50, 150, 250 along the support surface 42. A slot 48 may be formed in the wall 46 to facilitate placement and removal of the various inserts 50, 150, 250, as illustrated in FIG. 4.

The support portion 30 includes a plurality of support walls 32 extending generally vertically between a bottom surface 44 of the platform 40 and a top surface 24 of the base 20. The support walls 32 extend radially outwardly from a center axis of the support stand 10. In a specific embodiment, four support walls 32 are arranged orthogonally relative to each other. The support walls 32 expand in width from the platform 40 toward the base 20. By this arrangement, the support portion 30 provides stable support of the platform 40 above the base 20 and resists rocking or tipping of the stand 10 while the person is doing knuckle push-ups.

The push-up stands 10 may be molded in plastic so that the base 20, support portion 30 and platform 40 may be integrally formed. It should be appreciated, however, that the push-up stands may be constructed by assembling the base, support and platform as separate components, and forming these components from any suitable material, such as wood, metal, alloys, resins or any combination thereof, using any suitable process known by persons having ordinary skill in the art.

The bottom surface 22 may be provided with rubber feet or other non-slip materials to prevent slippage between the stand 10 and a floor upon which the stand 10 is placed.

The invention has been described in an illustrative manner. It is, therefore, to be understood that the terminology used is intended to be in the nature of words of description rather than of limitation. Many modifications and variations of the invention are possible in light of the above teachings. For example, the base of the push-up stand is shown illustratively as having an octagon shape. It should be appreciated that other shapes may be utilized, such as circular, square, etc. Thus, within the scope of the appended claims, the invention may be practiced other than as specifically described.

I claim:

1. A push-up stand comprising:

a base;

a support portion extending upwardly from the center of the base, the support portion including a plurality of support walls that extend generally vertically between a bottom surface of a platform and a top surface of the base; and said platform supported above the base by the support portion, the platform having an upper support surface for supporting the knuckles of a person doing knuckle push-ups, the platform having an upstanding wall extending along a perimeter of the upper support surface.

2. A push-up stand as set forth in claim 1, wherein the support walls extend generally radially outwardly from a center axis of the push-up stand.

3. A push-up stand as set forth in claim 2, wherein the support walls are generally orthogonal relative to each other.

4. A push-up stand as set forth in claim 1, wherein each support wall tapers in width from the base toward the platform.

5. A push-up stand comprising:

a base having opposite top and bottom surfaces;

a support portion extending upwardly from the top surface of the center of the base; and a platform supported above the base by the support portion, the platform having a generally planar upper support surface for supporting the knuckles of a person doing knuckle push-ups;

the support portion including a plurality of support walls that extend generally vertically between a bottom surface of the platform and the top surface of the base.

6. A push-up stand as set forth in claim 5, wherein the upper support surface is generally parallel with the bottom surface of the base.

7. A push-up stand as set forth in claim 5 including an upstanding wall extending along a perimeter of the upper support surface.

8. A push-up stand as set forth in claim 7, wherein the upstanding wall includes an open ended slot that extends between an top end of the upstanding wall and the upper support surface.

9. A push-up stand as set forth in claim 5, wherein the upper support surface is textured to promote a formation of calluses on the person's knuckles.

10. A push-up stand as set forth in claim 1, further comprising an insert having a shape corresponding to that of the upper support surface so as to be retained on the upper support surface by the upstanding wall.

11. A push-up stand as set forth in claim 10, wherein the insert provides a second support surface with a texture that is different from the texture of the upper support portion.

12. A push-up stand as set forth in claim 10, wherein the upstanding wall includes an open ended slot formed therein that allows access to a perimeter edge of the insert to facilitate placement and removal of the insert from the upper support surface.

13. A push-up stand as set forth in claim 11, wherein the insert is flexible to provide a cushioned second support surface.

14. A push-up stand as set forth in claim 11, wherein the insert has an abrasive second support surface.

15. A push-up stand as set forth in claim 5, further comprising an insert having a shape corresponding to that of the upper support surface so as to be retained on the upper support surface by the upstanding wail.

16. A push-up stand as set forth in claim 15, wherein the insert provides a second support surface with a texture that is different from the texture of the upper support portion.

17. A push-up stand as set forth in claim 16, wherein the insert is flexible to provide a cushioned second support surface.

18. A push-up stand as set forth in claim 16, wherein the insert has an abrasive second support surface.

* * * * *